US006092402A

United States Patent [19]

Porcelli et al.

[11] Patent Number: 6,092,402

[45] Date of Patent: Jul. 25, 2000

[54] SKI POLE ANTI-THEFT DEVICE

[76] Inventors: Raymond M. Porcelli, 10 Pine Glen Dr., P.O. Box 88, Blauvelt, N.Y. 10913; William Jones, 256 Wyckoff Ave., Ramsey, N.J. 07446

[21] Appl. No.: 09/288,176

[22] Filed: Apr. 8, 1999

[51] Int. Cl.[7] ..... E05B 73/00

[52] U.S. Cl. ..... 70/18; 70/58

[58] Field of Search ..... 70/14, 18, 19, 70/57, 58, 59–61, 16, 200

[56] References Cited

U.S. PATENT DOCUMENTS

| | | | |
|---|---|---|---|
| 1,376,221 | 4/1921 | Nordin | 70/200 |
| 1,652,233 | 12/1927 | Branick | 70/61 |
| 1,881,577 | 10/1932 | Hillyard | 70/16 |
| 3,667,259 | 6/1972 | Reque et al. | 70/18 X |
| 3,926,018 | 12/1975 | Joersz | 70/19 |
| 3,985,275 | 10/1976 | Allen . | |
| 4,057,983 | 11/1977 | Morgan . | |
| 4,059,209 | 11/1977 | Grisel | 70/58 X |
| 4,085,599 | 4/1978 | Fischer et al. | 70/19 X |
| 4,146,242 | 3/1979 | Bose | 70/58 X |
| 4,216,665 | 8/1980 | McKelvey | 70/58 |
| 4,245,745 | 1/1981 | Verelle et al. | 70/58 X |
| 4,326,747 | 4/1982 | Finnegan . | |
| 5,070,712 | 12/1991 | Fox | 70/18 |
| 5,193,366 | 3/1993 | Brinkman | 70/58 X |

FOREIGN PATENT DOCUMENTS

| | | | |
|---|---|---|---|
| 572981 | 3/1924 | France | 70/200 |
| 2556352 | 6/1977 | Germany | 70/18 |
| 2705241 | 8/1978 | Germany | 70/18 |
| 466722 | 11/1951 | Italy | 70/61 |
| 7072 | 5/1890 | United Kingdom | 70/457 |
| 21465 | 9/1897 | United Kingdom | 70/18 |

*Primary Examiner*—Suzanne Dino Barrett
*Attorney, Agent, or Firm*—W. Patrick Quast, Esq.

[57] ABSTRACT

A ski pole anti-theft device for providing economical and convenient anti-theft protection to the ski enthusiast is described. Two S shaped members with ski pole encompassing cut-outs pivotally snap fit together to secure a pair of ski poles. The ski pole anti-theft device is small enough to fit comfortably in a skier's jacket pocket. Used together with a padlock or cable/padlock or cable combination lock, the ski pole anti-theft device provides a convenient anti-theft system for both ski poles and skis wherever and whenever required.

11 Claims, 5 Drawing Sheets

38
32
16
22
12
18
14
28

48
54
42
10
52
50
40
38

SKI POLE ANTI-THEFT DEVICE

BACKGROUND

The invention relates to anti-theft devices for recreational equipment used while engaged in the sport of skiing, and in particular to devices and methods for securely locking ski poles.

Skiing is today an increasingly popular outdoor sport, and in keeping with the times the equipment, including skis and ski poles, has become ever more sophisticated and expensive. Despite the obvious camaraderie of the sport, theft of skis and ski poles is a real and constant concern of the participants. Relative security for the skis themselves is often provided at a ski lodge, with ski poles sometimes left unprotected adjacent the secured skis. And while resting from skiing on slopes or wooded areas one has to improvise some form of security or simply to leave equipment unprotected.

This concern of preventing theft of skis and ski poles has, of course, been addressed in the past as is evident from U.S. Pat. No. 3,985,275, issued Oct. 12, 1976, in which a carrier for skis and ski poles is disclosed. The carrier contains two mirror image channels 14, 16 (FIG. 1) for carrying the skis. The channels are hingedly connected 66, 68 (FIG. 1), having additionally four semi-circular cut-outs 46,48,62,64 (FIG. 1) for securing two ski poles when the carrier 10 is hinged together. Security for skis and ski poles is provided by a locking bar 12 (FIG. 1) sliding through apertures 20,22 (FIG. 2) in the carrier, the locking bar being secured to a tether 74 at one end, the other end of the tether then being secured by a padlock 88 so as to secure the skis, ski poles, and carrier to a suitable theft proof object. Again, in U.S. Pat. No. 4,057,983, issued Nov. 15, 1977, a lock for skis and ski poles is described. The lock 10 consists of a pair of clamp elements 18, 18' (FIG. 2) having a recess 20 for receiving a pair of skis. The elements are hingedly connected 64 (FIG. 5), and contain grooves (either 32,34 [FIG. 2], or 68, 70 [FIG. 6]) for securing a pair of ski poles. Means are provided for securing a flexible member 50 (FIG. 4) to said clamp by means of a padlock 48 to secure the clamp, skis, and ski pole to a theft proof object. Further, in U.S. Pat. No. 4,326,747, issued Apr. 27, 1982, a ski carrier with ski and ski pole locking features is disclosed. In this invention two tong-like body members 10, 11 (FIGS. 3–4) are interconnected at a pivot axis established by a pin 12 (FIG. 1). First and second jaws 15, 17 (FIG. 2) provide an aperture for securing a pair of skis below the pivot axis, while arcuate cavities 20, 22 (FIG. 2) provide the means for simultaneously securing a pair of ski poles. At the base of the ski carrying jaws 15, 17 aligned bores 46-45-47 may be used with a loop 48 (FIG. 1) of flexible cable connected to a detachable locking means (49) so as to secure the carrier, skis, and ski poles to a fixed reference.

While the above noted devices and method provide useful means for securing and transporting skis and ski poles they do not envision the convenience, economy and simplicity of the ski pole anti-theft device of the present invention, providing skiers with a pocket carrying ski pole security system immediately available whenever required.

It is therefore a primary object of the present invention to provide a ski pole anti-theft device that can be conveniently carried in the pocket of a jacket.

An additional object is to provide an economical, low-cost ski pole anti-theft device.

Still another object is to provide a ski pole anti-theft device that can be put in use simply and quickly when needed.

A further object is to provide a ski pole anti-theft device that works in conjunction with a variety of cable locks.

Yet another object of the invention is to provide a ski pole anti-theft device that works in conjunction with a variety of padlocks.

Another object of the present invention is to provide a ski pole anti-theft device which can be simultaneously employed as a security system for accompanying skis.

SUMMARY

These and other objects are obtained with the ski pole anti-theft device of the present invention.

As noted above theft of skis and/or ski poles is a real concern for skiers enjoying the sport. At a minimum, loss of some or all of your equipment will ruin an otherwise fine skiing vacation. Current anti-theft devices, while often providing convenience in transporting skis and poles, are somewhat bulky and cumbersome objects in and of themselves.

It occurred that providing a simple, easy to use ski pole anti-theft device that can be carried about in the pocket of a jacket would be a useful addition to an enjoyable skiing experience. To this end a ski pole anti-theft device has been devised to fulfill these requirements. The anti-theft device consists essentially of two substantially identically shaped mirror image members joined together at a central pivot point by a rivet. Each shaped member typically is longer in length than in width, and each has a pair of oppositely facing shaped cut-outs, each cut-out being positioned on opposite sides of the centrally positioned rivet. Each of the two members has a first smaller diameter aperture at one longitudinal end, and a second larger diameter aperture at its other longitudinal end. On the facing portion (that portion facing the other shaped member) of each shaped member typically in proximity to one of the apertures, a raised notch forms a detent on one side of the aperture, while a depressed notch dimensionally matching the raised notch forms a detent holder on the other side of the aperture. The raised and depressed notch on one face portion complement the depressed and raised notch on the other.

The ski pole anti-theft device of the invention is extremely simple to operate. When the two shaped members are co-extensively aligned two complete ski pole enclosures are formed by the shaped cut-outs in each member now forming an enclosure. The smaller diameter holes in each member are now aligned with each other, as are the larger diameter holes at the other end of each member. The detents and detent holders are now similarly aligned with the two detents now securely snap-fitted into the two detent holders.

In actual use the ski pole anti-theft device is simply pivoted from an aligned, co-extensive configuration to form an open jawed configuration in order to accept the shafts of one or two ski poles. The two members are then pivoted back into a closed, co-extensive position using manual pressure to enable the two facing detents to snap over one another and then be firmly secured into their respective detent holders. With one or two ski poles now secured within the anti-theft device, theft is now prevented by the insertion of a suitable padlock into one of the pair of aligned, matching holes at one end of the anti-theft device, the shackle of the padlock further ensnaring a suitable immovable reference object. A variety of cable locks, either making use of simple key operated padlocks or combinations locks can be used to further add to the over all utility of the ski pole anti-theft device system. For example, the cable on a typical cable lock can be threaded into one or both of the smaller and larger diameter aperture pair at each of the ends of the ski pole anti-theft device, and then around any convenient object serving as an immovable reference. Again, the cable can additionally extend through the bindings of the skis so as to provide a high degree of security not only for the ski poles, but also for the skis as well.

Obviously the ski pole anti-theft device must be fabricated in a sturdy material to resist tampering. Steel, or a suitable plastic such as nylon, can be employed. The two members are described as being pivotally secured by means of a rivet, such as a steel, aluminum, or plastic rivet. Of course, any convenient coupling means can be used.

DETAILED DESCRIPTION

Figure 1:
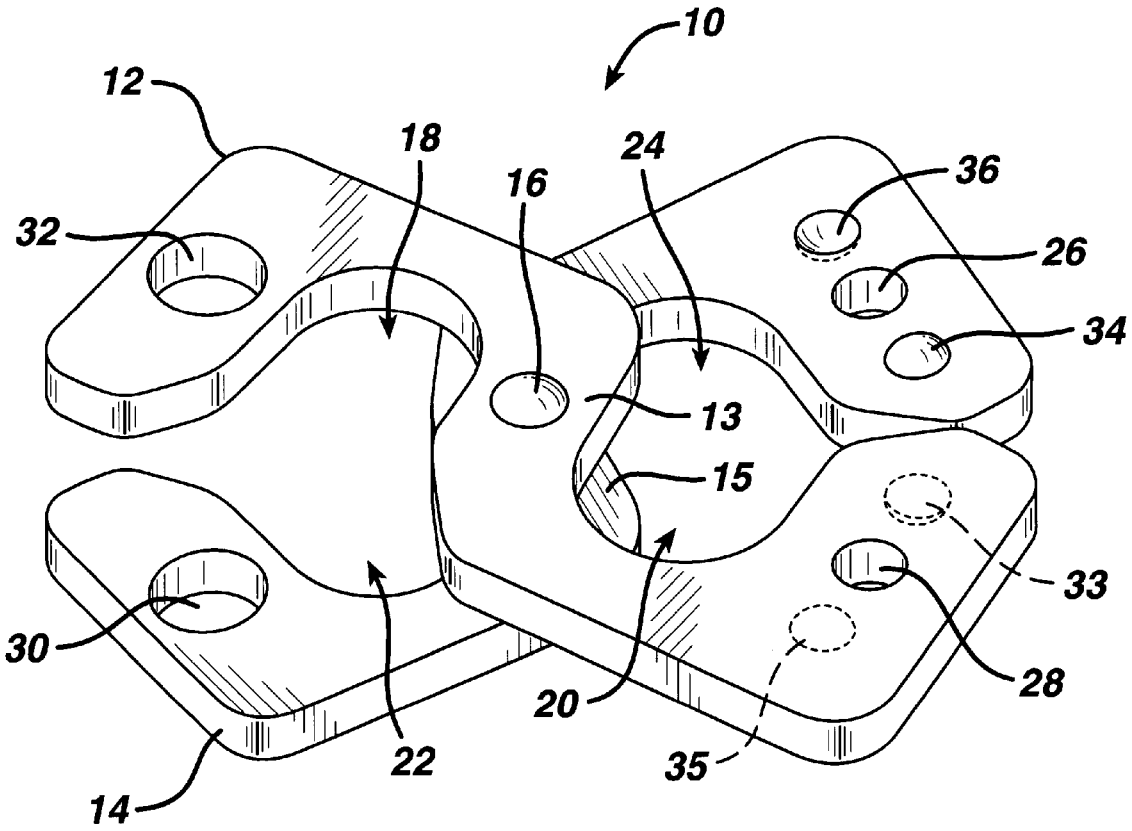
FIG. 1 is a partially diagrammatic, perspective view of one version of the ski pole anti-theft device of the invention showing the anti-theft device in open position with a detent and detent holder on one member shown in phantom.

Turning now to the drawings, in FIG. 1 a version of the ski pole anti-theft device 10 of the invention is shown. The ski pole anti-theft device 10 is illustrated in open, ski pole receiving position, being essentially comprised of first and second (12, 14) shaped members. The members in this embodiment are machined or molded out of a suitable plastic such as nylon, in an S shaped configuration. They are secured together by a steel rivet 16 passing through cross members 13 and 15 of shaped 12, 14 at an approximate center point on each member. The members 12, 14 are substantially mirror images of one another, although of course, they need not be. In one embodiment each member measures approximately 4" in length×1¾" wide×¼" thick. Each member has two oppositely positioned shaped cut-outs along its length, each cut-out measuring approximately 1½" in depth×1" in width so as to accommodate a wide variety of ski pole shaft 38. In the embodiment illustrated the first member 12 has first and second U shaped cut-outs 18, 20, and the second member 14 has matching third and fourth U shaped cut-outs 22, 24. Each of the cut-outs is positioned on either side of the centrally positioned rivet.

Figure 2:
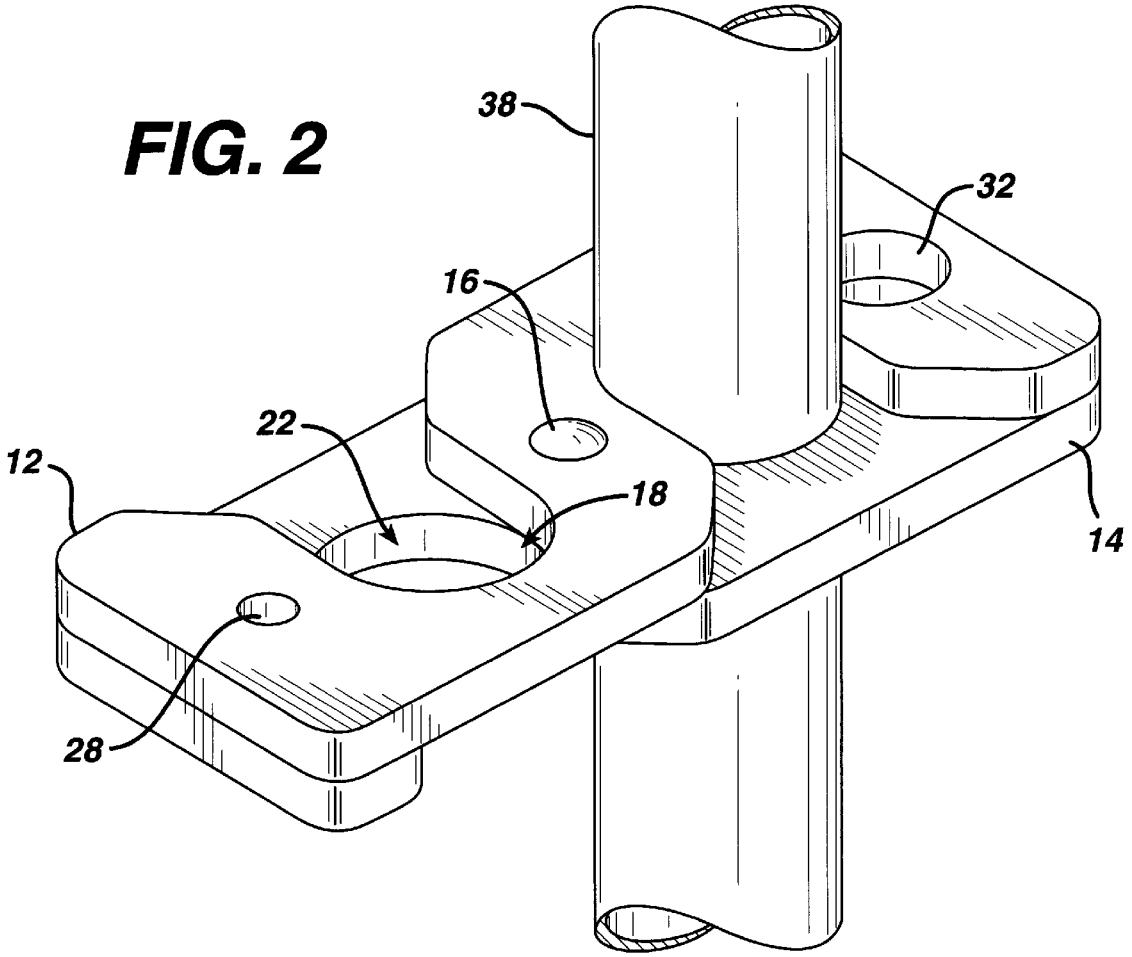
FIG. 2 is a perspective, side view of the version of the ski pole anti-theft device depicted in FIG. 1, illustrating the shaft of a ski pole positioned within the anti-theft device.
Figure 3:
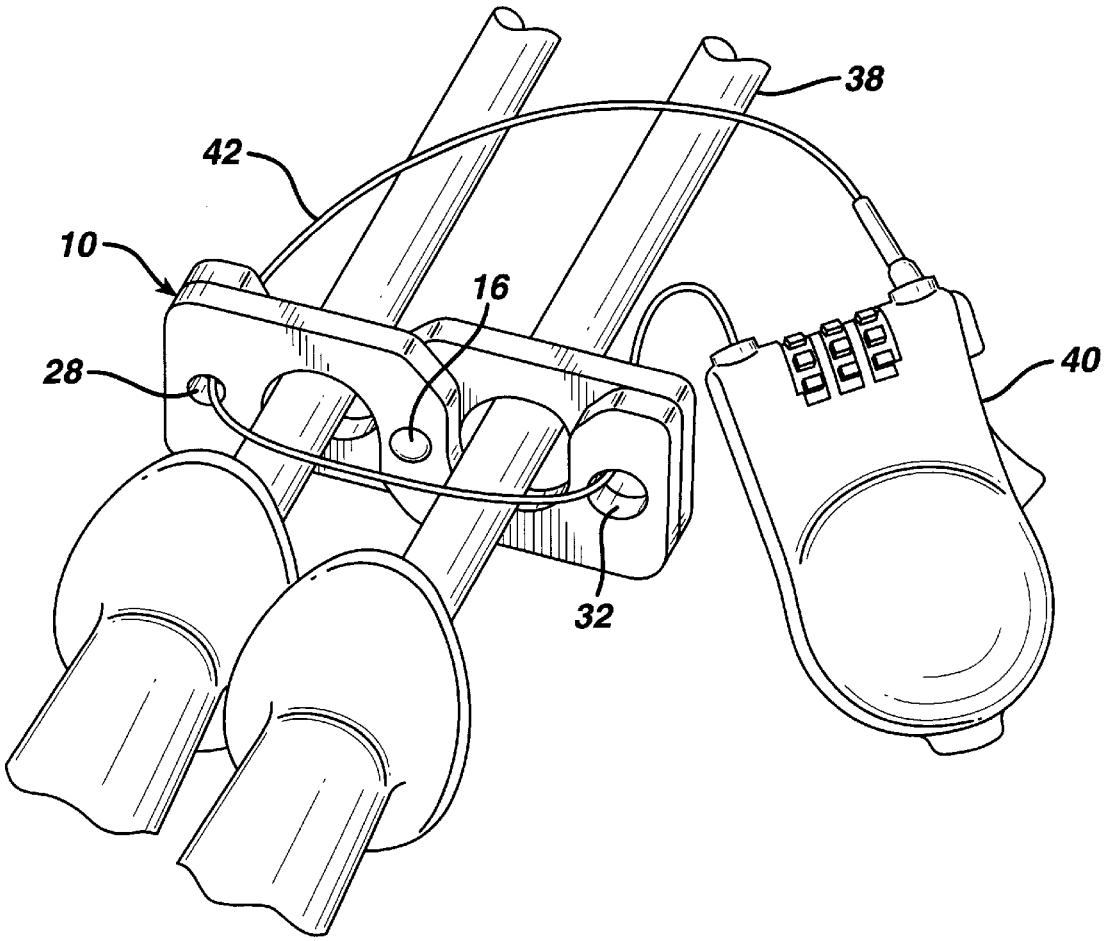
FIG. 3 is a perspective view of one version of the ski pole anti-theft device of the invention, showing a pair of ski pole shafts secured within the anti-theft device with an anti-theft combination cable lock in place.
Figure 5:
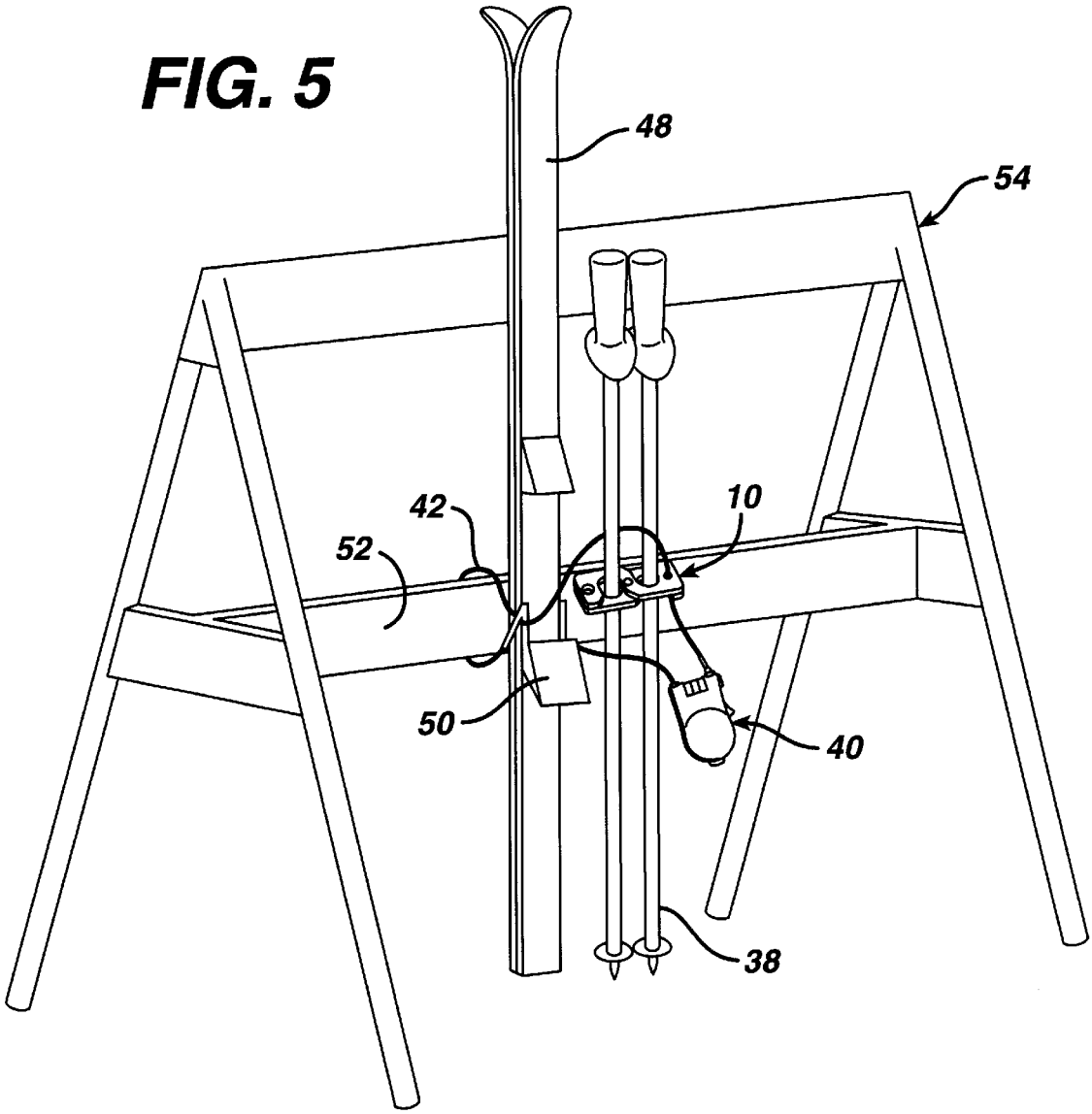
FIG. 5 is a perspective view of one version of the invention illustrating both ski poles and skis being secured to a ski rack by means of the ski pole anti-theft device and a combination cable lock.

As best seen in FIGS. 2, 3, and 5, when the first and second members are pivoted from open to closed position with one or two ski pole shafts being placed within the openings created by the U shaped cut-outs while in open position, one or two ski pole shafts 38 are now secured within the ski pole anti-theft device.

The members of the ski pole anti-theft device 10 are further provided with two matching apertures; a first smaller diameter aperture 28 in the first member, and a third smaller diameter aperture 26 in the second member; a second larger diameter aperture 32 in the first member, and a fourth larger diameter aperture 30 in the second member. The smaller diameter apertures are placed at one longitudinal end of each member, and the large diameter apertures are placed at the other longitudinal end. The smaller diameter apertures 26, 28 can have an approximate diameter of ¼" and the larger diameter apertures 30, 32 can have an approximate diameter of ½". A detent 34 and detent holder 36 is formed on the face portion (that side of each member facing the other when they are co-extensively aligned) of the first member 12, and a matching detent 33 and detent holder 35 (shown in dotted lines in FIG. 1) is formed on the face portion of the second member 14. Both detents 33, 34 consist of a raised hemispherically shaped portion, adjacent to and disposed to one side of the smaller diameter aperture. The detent holders 35, 36 consist of matching hemispherically shaped depressions, and are located adjacent to and disposed to the other side of the smaller diameter aperture. When the two members are pivoted from open (FIG. 1) to closed (FIG. 2) position, the two detents 33, 34 temporarily meet, then manual pressure caused them to slide over one another, and finally snap fit into the two detent holders 35, 36, thereby adding to the over-all security of the ski pole anti-theft device 10 in closed position.

Figure 4:
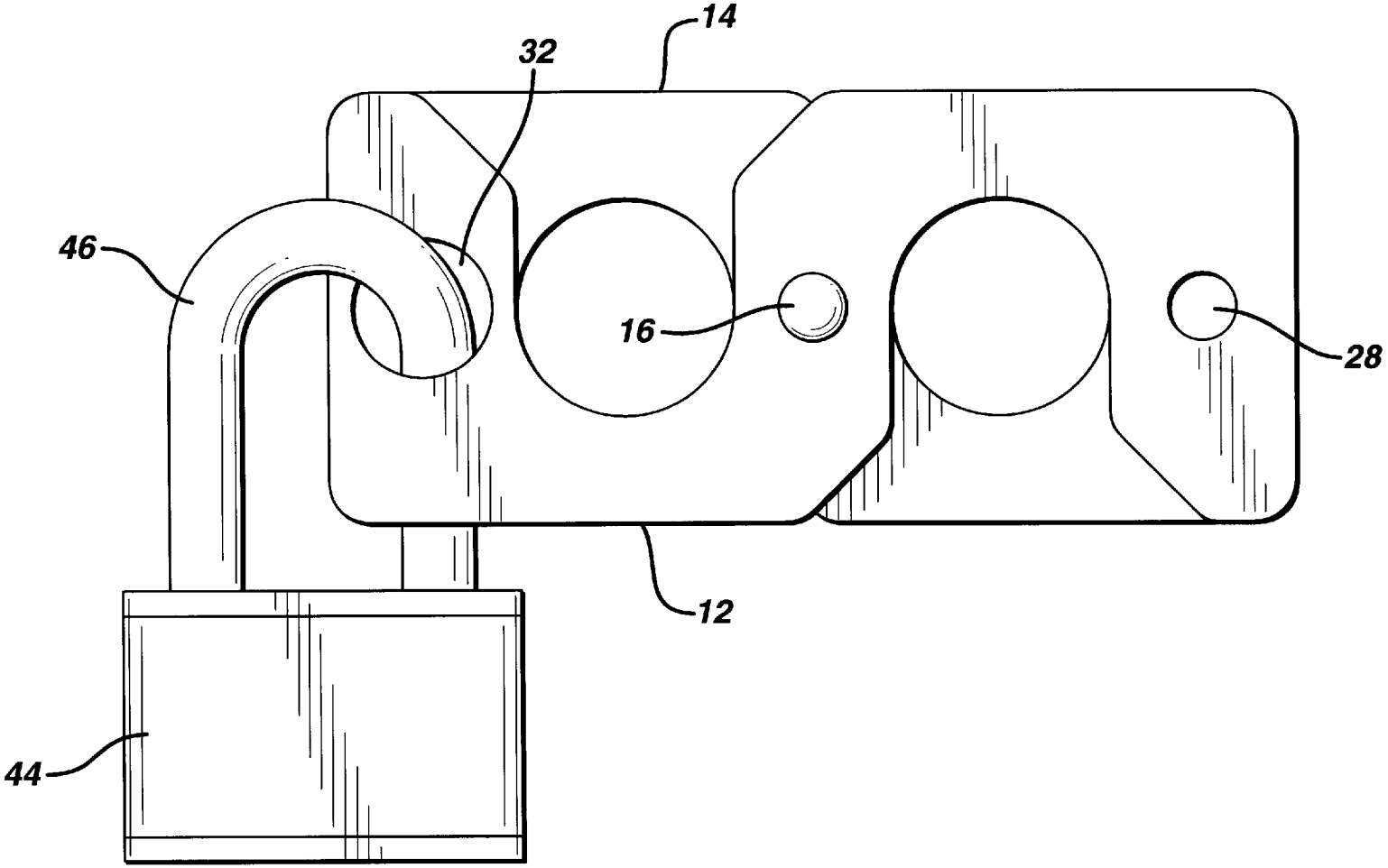
FIG. 4 is a top plan view of the version of the ski pole anti-theft device of the invention of FIG. 1, illustrating the anti-theft device in closed position and secured with a padlock.

FIGS. 3–5 illustrate the anti-theft feature of the present invention. In FIG. 4 the hasp 46 of a padlock 44 is shown passing through the matching larger diameter openings 30, 32 in the ski pole anti-theft device when the anti-theft device is in closed position. The hasp 46 can, of course, further ensure an immovable object, as, for example, the bar 52 of the ski rack 54 depicted in FIG. 5. FIGS. 3 and 5 illustrate the use of a standard cable combination lock 40 (which could also be a standard padlock) together with a suitable tether 42 (such as a steel cable) for anchoring the ski pole anti-theft device 10 to an immovable reference point. As seen in FIG. 3, the tether 42 can be routed through both the smaller 26, 28, and larger diameter 30, 32 matching apertures at either end of the ski pole anti-theft device. However, the object of the invention can be accommodated by passing the tether through one or the other of the matching aperture pairs. The differently sized apertures can be used to accommodate variations in standard ski cable thicknesses that are available in the industry or padlock shackles. Additionally, as seen in FIG. 5, the tether can further encircle the bindings 50 of a pair of skis 48 while securing the shafts 38 of a pair of ski poles to an immovable reference point, such as the bar 52 of a ski rack 54 depicted in FIG. 5.

The padlock 44, which can be either a key operated or a combination operated lock, and the cable combination lock 40 described are of conventional design and well known to the art. The tether 42 employed is envisioned as being of sufficient length to provide an anti-theft security system for both the ski poles within the ski pole anti-theft device 10 of the invention as well as the accompanying pair of skis 48.

Thus it can be seen the ski pole anti-theft device of the present invention provides a comforting new convenience for enthusiasts enjoying a skiing outing. An economical, easily deployed ski and ski pole security system is "jacket pocket" available to the skier whenever and wherever required.

While versions of the present invention have been shown in detail, various modifications and improvements will become readily apparent to those skilled in the art. Accordingly, the spirit and scope of the present invention is to be limited only by the following claims.

What is claimed is:

1. A ski pole anti-theft device for retention of ski poles, comprising:

(a) a first shaped member, including first and second shaped openings, said first shaped member disposed in a first plane, said first shaped member further including a first face surface and a third face surface, said first and third face surfaces disposed parallel to each other and separated by the thickness of the first shaped member;

(b) a second shaped member including third and fourth shaped openings, said second shaped member disposed in a second plane, said second shaped member further including a second face surface and a fourth face surface, said second and fourth face surfaces disposed parallel to each other and separated by the thickness of said second shaped member;

(c) each of said first and second shaped members having a respective cross member portion disposed between its respective shaped openings;

(d) means for pivotally connecting said cross member portion of said first shaped member to the cross member portion of said second shaped member about a pivot axis, said first face surface juxtaposed to said second face surface when said respective cross member portions are pivotally connected to each other, said third and fourth face surfaces disposed axially by the respective thickness of each said first and second shaped members, in opposite directions to each other along said pivot axis, when said respective cross member portions are pivotally connected to each other, whereby when said first shaped member is co-extensively aligned with said second shaped member, said first and third shaped openings are aligned to thereby form a first enclosed opening and said second and fourth shaped openings are aligned to thereby form a second enclosed opening such that when a shaft of a ski pole is placed in said first shaped opening of said first shaped member, and said first shaped member is thereafter co-extensively aligned with said second shaped member, the third shaped opening of said second shaped member is positioned around the shaft of said ski pole, so that when said first shaped member is co-extensively aligned with said second shaped member, the shaft of said ski pole is entrapped within said first enclosed opening; and, (e) means for resistantly retaining said first shaped member substantially co-extensively aligned with said second shaped member, whereby when at least one ski pole shaft is disposed within said first or second enclosed opening, said means for resistantly retaining said first shaped member co-extensively aligned with said second shaped member precludes rotatively pivoting said first shaped member in relation to said second shaped member a sufficient distance to enable said ski pole to be removed from said ski pole anti-theft device, wherein said means for resistantly retaining said first shaped member substantially co-extensively aligned with said second shaped member include said first shaped member having at least a first aperture of a first cross-sectional area and include said second shaped member having at least a second aperture of a second cross-sectional area, said first aperture and said second aperture substantially aligned when said first shaped member is co-extensively aligned with said second shaped member, said means for resistantly retaining further including lockable means adapted to be locked including a first portion, said first portion of said lockable means disposed through said first and second apertures when said first shaped member is co-extensively aligned with said second shaped member before said lockable means is locked.

2. The ski pole anti-theft device claimed in claim 1, said first face surface including disposed thereon at least one of a first group consisting of a first detent and a first detent holder, said second face surface including disposed thereon at least one of a second group consisting of a second detent and a second detent holder, said at least one of said first and second group disposed on said first and second face surfaces respectively, said at least one of said first and second group disposed on said first and second face surfaces selected so as to cooperatively engage each other when said first shaped member is co-extensively aligned with said second shaped member, whereby because of the cooperative engagement of a respective detent and detent holder, the pivoting of said first and second shaped members from a co-extensively aligned position is resisted.

3. The ski pole anti-theft device claimed in claim 2 wherein said first and second detents are raised protrusions each having a prescribed outline and wherein said first and second detent holders are depressed surfaces in the respective portion of said lockable means disposed through said first and second apertures and through said third and fourth apertures when said first shaped member is co-extensively aligned with said second shaped member before said lockable means is locked.

4. The ski pole anti-theft device claimed in claim 1 wherein said means for resistantly retaining said first shaped member substantially co-extensively aligned with said second shaped member include said first shaped member having a third aperture of a third cross-sectional area and said second shaped member having a fourth aperture of a fourth cross-sectional area, said third aperture and said fourth aperture substantially aligned when said first shaped member is co-extensively aligned with said second shaped member, said means for resistantly retaining further including said first portion of said lockable means disposed through said third and fourth apertures when said first shaped member is co-extensively aligned with said second shaped member before said lockable means is locked.

5. The ski pole anti-theft device claimed in claim 2 wherein said means for resistantly retaining said first shaped member substantially co-extensively aligned with said second shaped member include said first shaped member having a third aperture of a third cross-sectional area and said second shaped member having a fourth aperture of a fourth cross-sectional area, said third aperture and said fourth aperture substantially aligned when said first shaped member is co-extensively aligned with said second shaped member, said means for resistantly retaining further including said first portion of said lockable means disposed through said third and fourth apertures when said first shaped member is co-extensively aligned with said second shaped member before said lockable means is locked.

6. The ski pole anti-theft device claimed in claim 3 wherein a said means for resistantly retaining said first shaped member substantially co-extensively aligned with said second shaped member included said first shaped member having a third aperture of a third cross-sectional area and said second shaped member having a fourth aperture of a fourth cross-sectional area, said third aperture and said fourth aperture substantially aligned when said first shaped member is co-extensively aligned with said second shaped member, said means for resistantly retaining further including said first portion of said lockable means disposed through said third and fourth apertures when said first shaped member is co-extensively aligned with said second shaped member before said lockable means is locked.

7. The ski pole anti-theft device claimed in claim 1, wherein said first portion of said lockable means is of sufficient length so as to be threaded around a theft-resistant reference object.

8. The ski pole anti-theft device claimed in claim 4, wherein said first portion of said lockable means is of sufficient length so as to be threaded around a theft-resistant reference object.

9. The ski pole anti-theft device claimed in claim 7, wherein said first portion of said lockable means further securably engages bindings on a pair of skis.

10. The ski pole anti-theft device claimed in claim 8, wherein said first portion of said lockable means further securably engages bindings on a pair of skis.

11. The ski pole anti-theft device claimed in claim 1 wherein said ski pole anti-theft device is dimensioned so as to be carried about in a jacket pocket of a skier.

* * * * *

UNITED STATES PATENT AND TRADEMARK OFFICE

CERTIFICATE OF CORRECTION

PATENT NO. : 6,092,402
DATED : July 25, 2000
INVENTOR(S) : Raymond M. Porcelli and William Jones It is certified that error appears in the above-identified patent and that said Letters Patent is hereby corrected as shown below:

Column 6,
Lines 15-23, should be deleted and substitute therefor claim 3, as shown below:

-- 3. The ski pole anti-theft device claimed in claim 2 wherein said first and second detents are raised protrusions each having a prescribed outline and wherein said first and second detent holders are depressed surfaces in the respective face surfaces, the outline of said depressed surfaces complementing the prescribed outline of said raised protrusions. --

Line 53, delete the word "a" after the word "wherein".
Line 55, delete the word "included" and substitute therefor -- include --.

Signed and Sealed this

Fourth Day of December, 2001

*Attest:*

Nicholas P. Godici

*Attesting Officer*

NICHOLAS P. GODICI
*Acting Director of the United States Patent and Trademark Office*